US005146243A

United States Patent [19]

English et al.

[11] Patent Number: 5,146,243

[45] Date of Patent: Sep. 8, 1992

[54] DIAPHRAGM CAP SYSTEM FOR INK-JET PRINTERS

[75] Inventors: Kris M. English; J. P. Harmon, both of Vancouver; Jefferson P. Ward, Brush Prairie, all of Wash.

[73] Assignee: Hewlett-Packard Company, Palo Alto, Calif.

[21] Appl. No.: 737,943

[22] Filed: Jul. 29, 1991

[51] Int. Cl.[5] ..... B41J 2/165

[52] U.S. Cl. ..... 346/140 R; 346/75

[58] Field of Search ..... 346/140 R, 75

[56] References Cited

U.S. PATENT DOCUMENTS

| | | | |
|---|---|---|---|
| 4,437,105 | 3/1984 | Mrazek et al. | 346/140 R |
| 4,511,906 | 4/1985 | Hara | 346/140 R |
| 4,589,000 | 5/1986 | Koto et al. | 346/140 R |
| 4,638,336 | 1/1987 | Hofmann | 346/140 R |
| 4,684,963 | 8/1987 | Naka | 346/140 R |
| 4,853,717 | 8/1989 | Harmon et al. | 346/140 R |
| 4,970,534 | 11/1990 | Terasawa et al. | 346/140 R |
| 5,027,134 | 6/1991 | Harmon et al. | 346/140 R |

*Primary Examiner*—Benjamin R. Fuller
*Assistant Examiner*—Victor DeVito

[57] ABSTRACT

A birdirectionally movable carriage in an ink-jet printer contains either a color or a black ink cartridge. When a color cartridge is mounted on the carriage, a rotatable service station having both color and black cartridge service stations mounted thereon rotates to position the color service station adjacent the travel path of the color cartridge. A cap on the color service station includes a lip for sealing against the color cartridge and a flexible diaphragm which flexes to minimize pressure differentials between the interior and exterior of the cap. Because ink vapor diffusion through the diaphragm is possible, a diffusion vent is provided to a chamber on the side of the diaphragm exposed to the exterior of the cap. The diffusion vent permits diaphragm flexing while inhibiting ink vapor diffusion from the cap.

13 Claims, 3 Drawing Sheets

DIAPHRAGM CAP SYSTEM FOR INK-JET PRINTERS

BACKGROUND OF THE INVENTION

1. Field of the Invention

The present invention relates to ink-jet printers and more particularly to a service station in such a printer which includes a printhead cap having a flexible diaphragm.

2. Description of the Related Art

An ink-jet printer includes a replaceable printing cartridge having a printhead formed thereon. The cartridge includes a reservoir of ink which is fired through nozzles in the printhead onto a printing medium such as paper. The structure and operation of such printing cartridges is well-known to those skilled in the art.

There are two primary constraints for maintaining ink-jet printheads when they are not in use. First, a sealed environment must be provided for the nozzles to prevent them from drying. Secondly, pressure variations between the sealed environment and the ambient pressure must be minimized. A relative pressure decrease in the sealed environment can cause priming of the nozzles, which in a three chamber pin may result in color mixing. A pressure increase can deprime the nozzles which can render them inoperable.

Prior ink-jet printers include a service station at one end of the travel path of a printing carriage upon which the printing cartridge is mounted. The service station includes a wiper for wiping the printhead to remove contaminants, dried ink and the like from the printhead surface containing the nozzle openings. Also provided is a cap which covers the printhead to prevent the ink in the nozzles from drying. The printer may be programmed to fire ink from the nozzles into the cap to create ink vapor within the cap to reduce drying of ink in the printhead nozzles. Such firing also clears the nozzles of any viscous ink.

Prior art printhead caps for ink-jet printers include vents to prevent a pressure differential across the nozzles. In an unvented cap a pressure spike may occur as the cap moves into and out of sealing engagement with the printhead. Pressure fluctuations may also result from temperature or altitude changes. The vent tends to reduce the magnitude of the spike, but also allows vapor to diffuse from the cap thereby increasing ink drying in the nozzles.

Ink drying in the nozzles is proportional to the rate of vapor diffusion from the cap. The rate of vapor diffusion is proportional to the cross-sectional area over which diffusion can occur divided by the length of the diffusion path. In order to minimize vapor diffusion it is therefore desirable to minimize the cross-sectional area of the vent while maximizing its length.

In addition to equalizing pressure, prior art vents also serve as a flow path to drain ink which collects in the cap therefrom. Prior art vents can clog with ink and thus cause undesirable pressure differentials across the nozzles. On the other hand, when the vent is made sufficiently large to prevent clogging, the vent is not a sufficiently effective vapor barrier to prevent drying of the ink in the printhead nozzles.

It would be desirable to provide a service station for an ink-jet printer which functioned as a highly effective vapor diffusion barrier without vent clogging.

SUMMARY OF THE INVENTION

The present invention comprises a cap for an ink-jet printhead having nozzles from which ink is discharged. The cap is urgeable against the printhead for covering the nozzles. At least a portion of the cap is sufficiently flexible to deflect in response to a pressure increase interior of said cap caused when the cap is urged against the printhead.

In another aspect of the invention, a vapor diffusion barrier is formed adjacent the flexible portion of the cap. A diaphragm deflection chamber is defined between the barrier and the cap. One end of a vent formed in the diffusion barrier is in communication with the chamber and the other end is vented to ambient pressure.

The printhead cap and service station of the invention prevent drying of ink in the printhead nozzles by providing a highly effective vapor diffusion barrier and further prevent clogging of a printhead-cap vent. The present invention is especially advantageous with any highly viscous ink.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
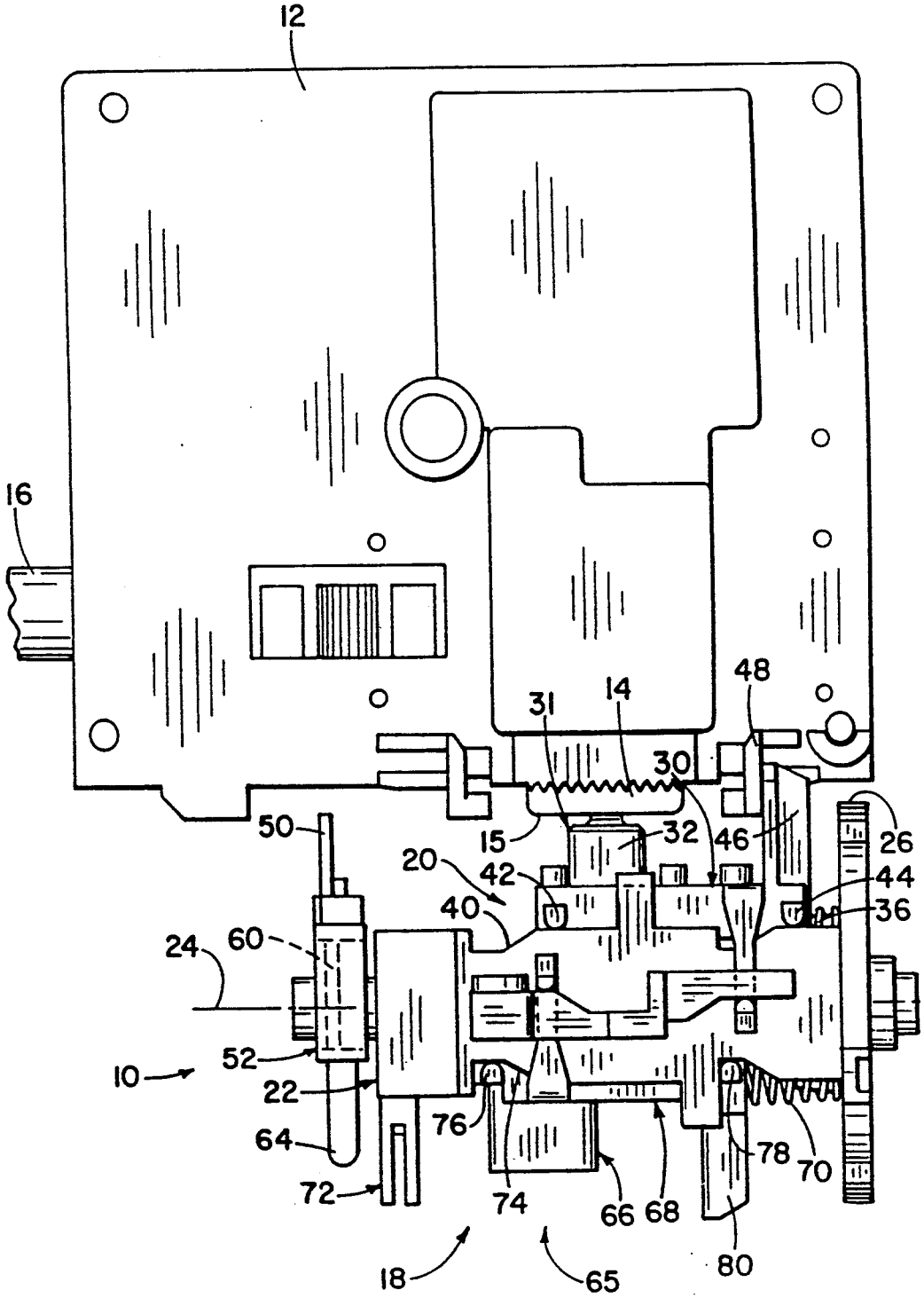
FIG. 1 is a partial front elevational view of an ink-jet printer illustrating an ink-jet printhead and a service station constructed in accordance with the present invention.
Figure 2:
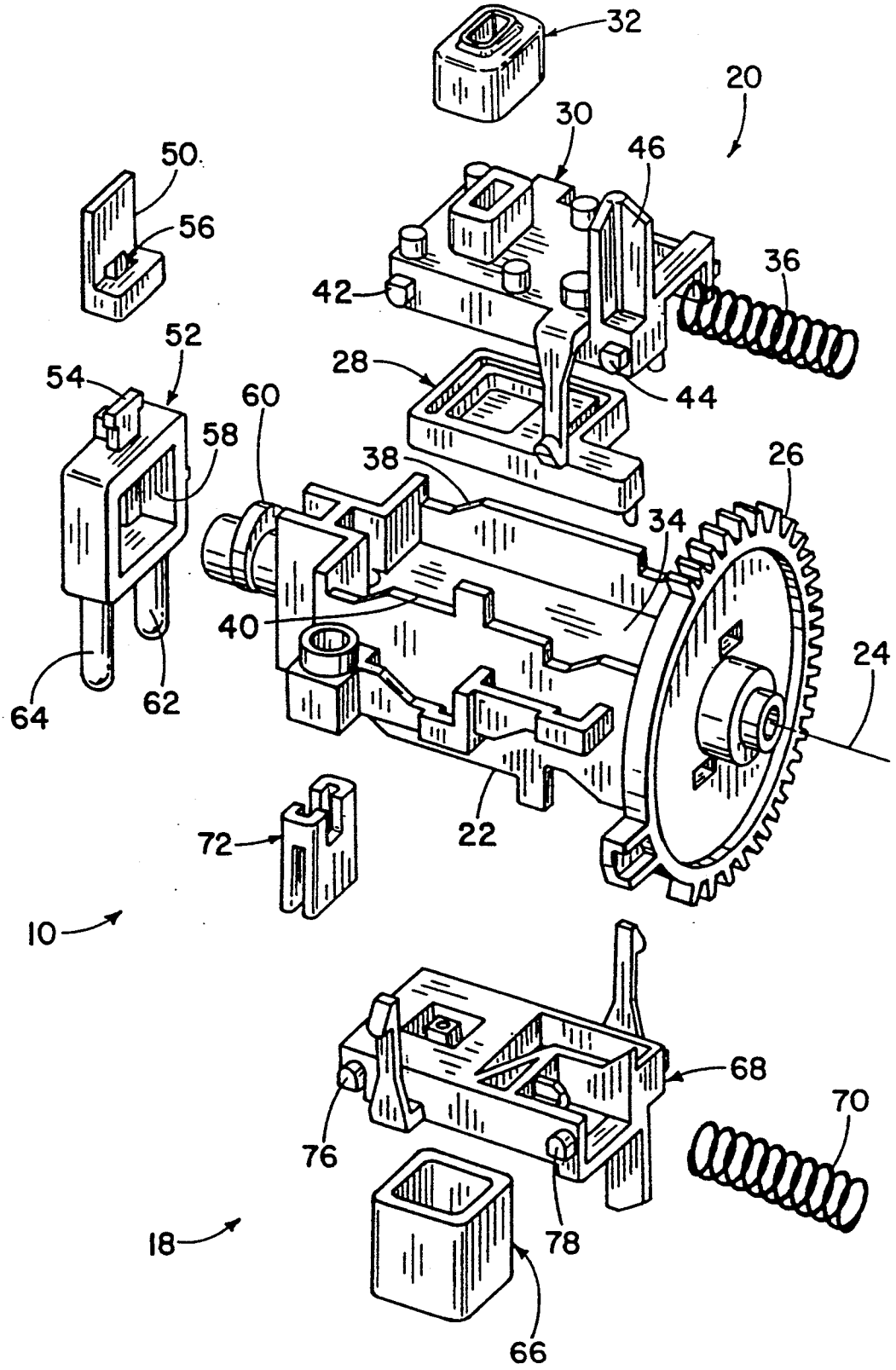
FIG. 2 is an exploded perspective view of both the black cartridge service station and the color cartridge service station of FIG. 1.

Indicated generally at 10 in FIGS. 1 and 2 is a service station for both black cartridge and color cartridge printheads constructed in accordance with the present invention. Service station 10 is incorporated into an ink-jet printer into which either a color cartridge or black cartridge may be loaded for color or black ink printing. The printer includes a carriage 12 which is shown in the view of FIG. 1 having a black cartridge 14 (shown partially broken away) mounted thereon. Cartridge 14 includes a printhead 15 having nozzles (not shown) formed therein for firing ink in the cartridge therefrom. Carriage 12 is bidirectionally moveable along a guide rod 16 which substantially spans the width of the printer. The carriage is shown in its rightmost position, as viewed in FIG. 1, which places cartridge 14 in service station 10. Carriage 12 moves to the service station when the printer is not printing or when the printhead needs servicing. On other printers the service station may be located at the leftmost side of the printer.

Although not shown for clarity, the printer includes structure for guiding paper through the printer so that the paper surface is positioned immediately beneath printhead 15 when carriage 12 moves leftwardly from service station 10.

Service station 10 includes a color cartridge service station, indicated generally at 18, and a black cartridge service station, indicated generally at 20. Service stations 18, 20 are mounted 180° apart on a rotatable carrier 22. Carrier 22 is rotatable 180° about an axis 24. The carrier rotates responsive to a driven gear (not shown) which engages with a sprocket 26 on carrier 22. If a color cartridge, instead of black cartridge 14, is mounted on carriage 12, carrier 22 rotates 180° so that color station 18 is oriented upwardly with black station 20 assuming the position shown for the color station in FIG. 1. On the other hand, with black cartridge 14 mounted on carriage 12, carrier 22 is in the position illustrated in FIG. 1.

Black station 20 includes a cap indicated generally at 31. The cap includes a basin structure 28, a black sled 30 and a black sled cover 32 all of which are received in a tray 34 formed in carrier 22. A spring 36 biases sled 30, as well as sled cover 32 and basin structure 28 which are mounted on the sled, to the left as viewed in FIG. 1. Tray 34 includes a pair of opposed cam surfaces, 38, 40 upon which cam followers, like cam followers 42, 44 ride. A post 46 presents a leftward-facing surface which engages with an arm 48 on carriage 12 as the carriage moves to the right. As can be seen in FIG. 1, when carriage 12 moves leftwardly from the service station, spring 36 biases sled 30 to the left. Followers 42, 44 ride surface 40 downwardly thus lowering the sled from the view of FIG. 1. Conversely, as the sled moves toward the service station, arm 48 engages post 46 thus moving sled 30 to the right and upwardly. Such action urges sled cover 32 against printhead 15.

As the black cartridge moves into the station, printhead 15 traverses the tip of a wiper 50 which wipes ink and debris from the printhead surface. Wiper 50 is mounted on a follower bracket 52. The follower bracket includes a post 54 which is received in an opening 56 formed in wiper 50. A rectangular frame 58 surrounds a cam 60 mounted on carrier 22. A pair of downwardly extending posts 62, 64 are received in a pair of corresponding holes (not shown) contained in printer structure (also not shown) beneath carrier 22 in FIG. 1. It can be seen that bracket 52 is maintained in an upper position by cam 60 when carrier 22 is in the position illustrated in FIG. 1. When the carrier rotates 180°, the bracket moves to a lower position as cam 60 rotates from under the bracket.

Color station 18 includes a color cap indicated generally at 65. The color cap includes a sled cover 66 and a color sled 68 (which is also referred to herein as a base). A spring 70 biases the sled to the left in FIG. 1. sled cover 66 is mounted on sled 68. When a color cartridge (not shown), rather than black cartridge 14, is mounted on carriage 12, carrier 22 is rotated 180° about axis 24 thus directing sled cover 66 in an upward direction. When carrier 22 so rotates, cam 60 inverts and drives bracket 52 to its lower position. A color wiper 72 which is mounted on carrier 22 is then also directed upwardly.

A cam surface 74 (in FIG. 1), such being similar to surface 40, is formed on carrier 22. Cam followers 76, 78 ride on the surface similar to the manner in which followers 42, 44 ride on surface 40. An arm 80 extends from color sled 68 in the same fashion that arm 46 extends from black sled 30.

With a color cartridge (not shown) mounted on carriage 12 instead of black cartridge 14, movement of color sled 68 relative to carriage 12 is similar to that previously described for black sled 30. As carriage 12 moves to the right toward the position illustrated in FIG. 1, the color printhead is wiped by wipers 72 the tips of which extend above the tips of wiper 50, which is in its lower position. Next, arm 48 on carriage 12 strikes post 80 thereby moving color sled 68 upwardly and to the right. Sled cover 66 is thus urged against the color printhead.

Figure 3:
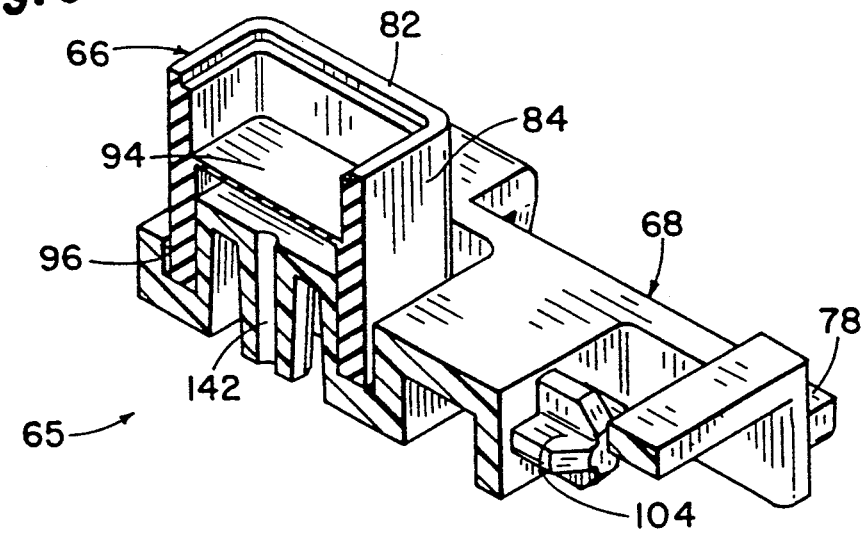
FIG. 3 is an enlarged perspective view, shown in cross-section, of the color cartridge service station of FIGS. 1 and 2.
Figure 4:
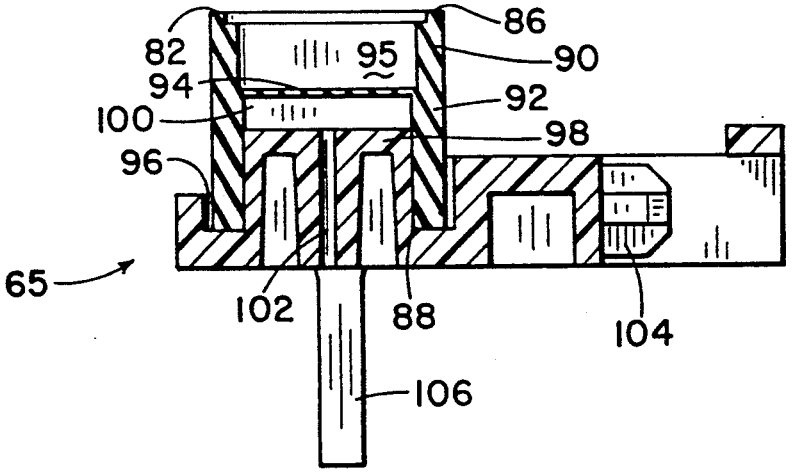
FIG. 4 is an elevational section view of the color cartridge service station of FIG. 3.
Figure 5:
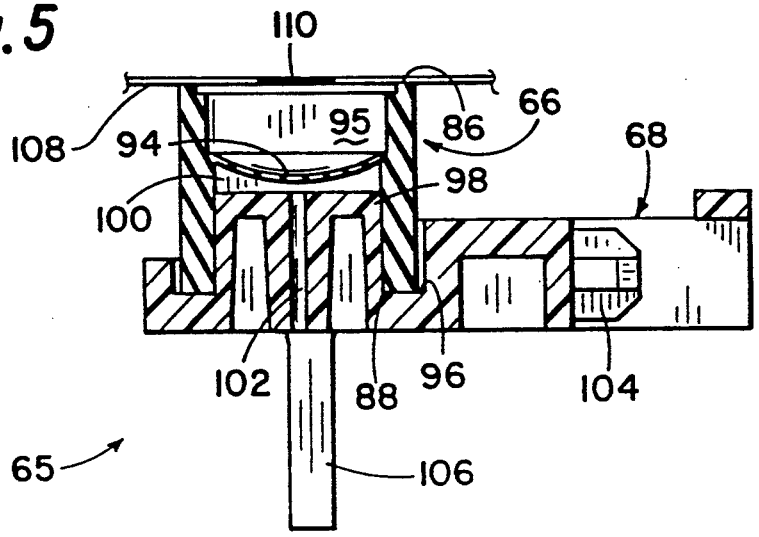
FIG. 5 is a view similar to FIG. 4 with the color cartridge cap urged against a printhead.

Turning now to FIGS. 3–5 consideration will be given in more detail to the structure of cap 65. In the present embodiment of the invention color sled cover 66 is molded from ethylene propylene diene monomer (EPDM) having a hardness of 35 Shore A. The sled cover includes an upper sealing lip 82 (also referred to herein as sealing means) which is formed on an upper surface of a tubular structure or member 84 having a substantially rectangular cross section, best viewed in FIG. 2. As seen in FIGS. 4 and 5, member 84 includes an upper opening 86 which is bounded by the inner perimeter of lip 82, and a lower opening 88, also viewable in FIG. 2.

Tubular member 84 comprises an upper wall 90 and a lower wall 92 which are integrally formed. As can be seen in FIGS. 4 and 5, wall 90 is slightly thinner than wall 92.

At the juncture of walls 90, 92 a diaphragm 94 is joined to tubular member 94 about an inner perimeter thereof thus sealing that portion of the tubular member bounded by wall 90 from that portion bounded by wall 92. The portion of sled cover 66 between diaphragm 94 and lip 82 comprises a chamber 95, such being also referred to herein as a cavity.

In the present embodiment of the invention, all of sled cover 66 is integrally molded from EPDM having uniform hardness and flexibility. Because diaphragm 94 is thinner than tubular member 84, the diaphragm flexes more easily than the tubular member. Similarly, because upper wall 90 is thinner than lower wall 92 there is slightly more flex in the upper wall relative to the lower wall. In the present embodiment of the invention, upper wall 90 is sufficiently flexible so that a person may apply lateral and downward pressure against upper wall 90 with his or her finger to deform the cap to the extent that the upper wall folds over against the diaphragm. Upper wall 90 is, however, sufficiently rigid that no drooping or sagging of the wall occurs when pressure is not applied thereto.

Considering now color sled 68, in the present embodiment sled 68 is made from nylon 6–10 30% GF. Relative to color sled cover 66, sled 68 is substantially rigid. The sled includes a substantially square recessed groove 96. A substantially square portion 98 of the base extends upwardly interior of groove 96. Portion 98 is also referred to herein as a vapor-impervious or vapor-diffusion barrier. sled cover 66 is mounted on sled 68 via an interference fit between portion 98 and the lower portion of tubular member 84. Due to the flexibility of lower wall 92 of the cap and the relative dimensions of square portion 98 and lower wall 92, a seal between square portion 98 and lower wall 92 is formed about the circumference of the cap. A diaphragm deflection chamber 100 is formed between diaphragm 94 and square portion 98. A vent 102 comprises a bore having an upper opening in communication with chamber 100 and a lower opening in communication with the exterior of sled 68. The lower opening of vent 102 is also visible in FIG. 2.

Sled 68 further includes a lug 104 over which one-end of spring 70 (in FIGS. 1 and 2) is received. The sled further includes a pair of downward extending legs, one of which is leg 106, which act to retain the sled on carrier 22 while permitting lateral and vertical sled movement as previously described.

In operation, carriage 12 has a color cartridge (not shown) mounted thereon rather than black cartridge 14. Carrier 22 is rotated 180° about axis 24 thus placing opening 86 in sled cover 66 immediately beneath the line of travel of the color cartridge printhead. As carriage 12 moves to the right toward the position illustrated in FIG. 1, arm 48 strikes post 80 thus moving color sled 68 to the right as carriage travel continues. During such movement, the cams, like cams 76, 78, which support the color sled on the carrier move up cam surface 74. This action moves sled cover 66 toward the color printhead. As carriage 12 reaches the position illustrated in FIG. 1, sled cover 66 drives into color printhead 108 (in FIG. 5) beneath a nozzle plate 110 bearing the nozzles (not shown) through which the color cartridge ejects ink onto paper in the printer.

Lip 82 and upper wall 90 are sufficiently flexible to permit sealing against the lower surface of printhead 108 as illustrated in FIG. 5 and to accommodate any difference in manufacturing tolerances between the cap and the printhead. As lip 82 strikes the printhead, the pressure in chamber 95 rises thus causing diaphragm 94 to deflect downwardly as illustrated in FIG. 5. Such deflection is possible because of the highly flexible nature of membrane 94 and because chamber 100 is vented to atmosphere via vent 102.

Diaphragm 94 provides an effective liquid barrier between chamber 95 and vent 102 thus preventing moisture from clogging vent 102. Vent 102 also serves, as mentioned above, to vent between chamber 100 and atmospheric pressure to permit deflection of diaphragm 94 as shown in FIG. 5. Because vapor diffusion through diaphragm 94 is possible, it is advantageous and desireable for vent 102 to be substantially elongate and relatively narrow in diameter thus minimizing diffusion from chamber 100 to atmosphere. So minimizing the diffusion reduces diffusion from chamber 95 to chamber 100 through diaphragm 94 and thereby inhibits ink drying in the nozzles.

It should be appreciated that diaphragm 94 serves to prevent large pressure differentials between chamber 95 and the ambient pressure regardless of the effect tending to cause the pressure differential, e.g., pressure differentials brought about as a result of temperature variations or altitude excursions. Diaphragm 94 flexes upwardly in the event of an effect tending to reduce pressure in chamber 95 relative to ambient pressure, e.g., when carriage 12 moves leftwardly from a position in FIG. 1 and spring 70 returns color sled 68 to its leftward, lower position. As cup 66 draws away from printhead 108, pressure in chamber 95 tends to drop relative to ambient pressure with such a tendency being counteracted by upward flexing of diaphragm 94.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A cap system for an ink-jet printhead having nozzles from which ink is discharged, said cap system comprising:

a tubular structure having first and second openings at opposite first and second ends respectively, and an interior disposed between the openings, said nozzles being in communication with one of said openings when the printhead is urged against said first end of said tubular structure;

a diaphragm sealingly disposed across the interior of said structure thereby preventing liquid communication between the openings;

means for sealing between said first opening and said printhead about said nozzles, said first end being sufficiently flexible to seal against said printhead and said diaphragm being sufficiently flexible to deflect when the printhead is urged against said one end;

a substantially vapor-impervious barrier formed across said second opening for limiting vapor diffusion through said diaphragm; and an elongate vent having one end in communication with a space between said diaphragm and said barrier and another end in communication with an exterior portion of said tubular structure for permitting diaphragm deflection when said printhead moves toward or away from said first opening.

2. The cap system of claim 1 wherein said tubular structure and said diaphragm are integrally formed.

3. A cap system for use in an ink-jet printer having a bidirectionally movable print carriage supporting a printhead having ink nozzles thereon, said cap system being fixed along a travel path of the print carriage and comprising:

a cap urgeable against the printhead when said carriage is adjacent said cap system;

a chamber defined in said cap;

a cap opening in communication with said chamber, said nozzles being in communication with said opening when said cap is urged against said printhead;

a diaphragm having a first side exposed to pressure in said chamber;

a substantially vapor-impervious barrier formed adjacent a second side of said diaphragm and defining a diaphragm deflection chamber between said barrier and said diaphragm for limiting vapor diffusion through said diaphragm; and an elongate vent having a first end in communication with said diaphragm deflection chamber and a second end in communication with an exterior portion of said diaphragm deflection chamber for permitting diaphragm flexing when said cap moves toward or away from said printhead.

4. The cap system of claim 3 wherein said cap system further includes means for sealing between said cap and said printhead when said printhead is urged against said cap.

5. The cap system of claim 3 wherein said diaphragm is formed from material which is sufficiently flexible to deflect in response to a chamber pressure increase caused by urging the cap against the printhead.

6. The cap system of claim 3 wherein said cap comprises a tubular member having a substantially rectangular cross section and wherein a perimeter of said diaphragm is sealingly engaged with said member about an inner perimeter thereof.

7. The cap system of claim 3 wherein said cap and said diaphragm are integrally formed.

8. Apparatus for minimizing drying of ink in nozzles formed on an ink-jet printhead, said apparatus comprising:

a cap being urgeable against said printhead for covering said nozzles, at least a portion of said cap being sufficiently flexible to deflect in response to a pressure increase interior of said cap caused when said cap is urged against the printhead;

a vapor diffusion barrier formed adjacent said flexible portion and defining a diaphragm deflection chamber between said barrier and said cap, said vapor diffusion barrier limiting vapor diffusion from said diaphragm deflection chamber; and a vent having two ends forming in said vapor diffusion barrier in which one of said ends is in communication with said diaphragm deflection chamber and the other end of said ends vented to ambient pressure for permitting cap flexing when said cap moves toward or away from said printhead.

9. The apparatus of claim 8 wherein said sufficiently flexible portion comprises a diaphragm and wherein a portion of the cap urgeable against the printhead is less flexible than said diaphragm but is sufficiently flexible to seal between the cap and the printhead when said cap is urged against the printhead.

10. The apparatus of claim 9 wherein said vapor diffusion barrier is defined in a substantially rigid base upon which said cap is mounted.

11. The apparatus of claim 10 wherein said less flexible portion comprises a tubular member having an opening at each end thereof and wherein said diaphragm is sealingly engaged with said member about an inner perimeter thereof.

12. The apparatus of claim 11 wherein said tubular member and said vapor diffusion barrier are substantially impervious to vapor diffusion and wherein said diaphragm is subject to some vapor diffusion.

13. The apparatus of claim 12 wherein said tubular member has a first end sealingly engaged with said printhead about said nozzles when said cap is urged against said printhead, said vapor diffusion barrier is defined in a substantially rigid base and wherein a second end of said tubular member is mounted on said base.

* * * * *